US007275466B2

(12) United States Patent
Cluthe

(10) Patent No.: US 7,275,466 B2
(45) Date of Patent: Oct. 2, 2007

(54) MULTIPLE-BIT DRIVER WITH SPRING-LOADED ACTUATION

(75) Inventor: Gary Paul Cluthe, Waterloo (CA)

(73) Assignee: Duron Plastics Limited, Waterloo, Ontario (CA)

( * ) Notice: Subject to any disclaimer, the term of this patent is extended or adjusted under 35 U.S.C. 154(b) by 141 days.

(21) Appl. No.: 11/076,920

(22) Filed: Mar. 11, 2005

(65) Prior Publication Data

US 2006/0201291 A1 Sep. 14, 2006

(51) Int. Cl.
*B25B 23/00* (2006.01)
*B25B 23/16* (2006.01)
*B25G 1/08* (2006.01)

(52) U.S. Cl. ..... 81/439; 81/177.4

(58) Field of Classification Search ..... 81/439, 81/177.4, 490, 436, 437
See application file for complete search history.

(56) References Cited

U.S. PATENT DOCUMENTS

| | | | | |
|---|---|---|---|---|
| 1,910,275 | A | 5/1933 | Alden | |
| 2,629,423 | A | 2/1953 | Stettler | |
| 2,635,661 | A | 4/1953 | Egan | |
| 2,854,745 | A | 10/1958 | Braverman | |
| 3,006,395 | A | 10/1961 | Dye | |
| 3,233,593 | A | 2/1966 | Bowlby et al. | |
| 3,274,976 | A | 9/1966 | Levoin | |
| 3,750,729 | A | 8/1973 | Lemieux | |
| 4,372,362 | A * | 2/1983 | Ahn | 81/436 |
| 4,480,668 | A * | 11/1984 | Lin | 81/439 |
| 4,716,795 | A | 1/1988 | Corona et al. | |
| 4,762,036 | A | 8/1988 | Orlitzkey et al. | |
| 4,768,405 | A | 9/1988 | Nickipuck | |
| 4,953,640 | A | 9/1990 | Kurt | |
| 5,325,745 | A | 7/1994 | Koehler | |
| 5,337,637 | A | 8/1994 | Bih-Lien | |
| 5,526,721 | A | 6/1996 | Waisvisz | |
| 5,673,600 | A | 10/1997 | Yanagi et al. | |
| 5,740,706 | A * | 4/1998 | Tseng | 81/490 |
| 5,813,296 | A | 9/1998 | Hoff et al. | |
| 6,205,893 | B1 * | 3/2001 | Sato | 81/439 |
| 6,332,384 | B1 | 12/2001 | Cluthe | |
| 6,394,715 | B1 | 5/2002 | Boyle et al. | |
| 6,554,516 | B1 | 4/2003 | Christopher | |
| 2002/0007705 | A1 * | 1/2002 | Beauchamp | 81/490 |
| 2002/0176731 | A1 | 11/2002 | Torii | |

FOREIGN PATENT DOCUMENTS

| | | |
|---|---|---|
| CA | 2061648 | 8/1993 |
| DE | 297 08 384 | 8/1997 |
| DE | 298 20 263 | 1/1999 |
| JP | 11221778 | 8/1999 |

* cited by examiner

*Primary Examiner*—Hadi Shakeri
(74) *Attorney, Agent, or Firm*—R. Craig Armstrong; Borden Ladner Gervais LLP

(57) ABSTRACT

The driver has a number of cartridges assembled around a central axis, engaging each other along abutting longitudinal edges. Each cartridge has its own spring-loaded mechanism for extending or retracting a bit through a central axial opening of a collar at the distal end of the tool. The mechanism translates a small movement of an actuation button into rapid and much larger movement of the bit associated with that cartridge, whether that movement is extension or retraction.

10 Claims, 8 Drawing Sheets

MULTIPLE-BIT DRIVER WITH SPRING-LOADED ACTUATION

BACKGROUND OF THE INVENTION

1. Field of the Invention

The invention relates to a hand tool having multiple bits or other tool elements selectable for use one at the time. The bits or tool elements are movable between a retracted storage position within the handle of the tool, and an extended operative position.

The hand tool is normally a screwdriver. However, while the words "screwdriver" and "bits" are used for convenience throughout this description, it should be understood that these words are intended to be interpreted liberally, and thus could include hand tools with such tool elements as pen/pencil or scribing tips, or other non-screwdriver bits.

The invention is particularly directed towards a mechanism for more easily extending and retracting the bits or other tool elements to and from their operative position.

2. Description of the Prior Art

In the past, different approaches have been tried to provide a hand tool or screwdriver having a plurality of bits accessibly stored in the handle of the screwdriver. Examples include U.S. Pat. No. 3,750,729 (Lemieux), U.S. Pat. No. 5,325,745 (Koehler), Canadian patent no. 2,353,911 (Beauchamp), and U.S. Pat. No. 6,332,384 (Cluthe). The latter reference is by the present inventor.

In prior art tools of this type, advancing or retracting bits has generally involved sliding an actuation button through a distance corresponding to the distance the bit is moved, and engaging a locking mechanism

SUMMARY OF THE INVENTION

It is an object of this invention to provide a mechanism which more easily extends and retracts the bits or other tool elements to and from their operative position, than in the prior art tools.

In the invention, a number of cartridges are assembled around a central axis, engaging each other along abutting longitudinal edges. Each cartridge has its own spring-loaded mechanism for extending or retracting a bit through a central axial opening of a collar at the distal end of the tool. The mechanism translates a small movement of an actuation button into rapid and much larger movement of the bit associated with that cartridge, whether that movement is extension or retraction.

Once extended, the bit may be locked in place by any suitable means, for example an automatically-locking collar of the type described in the inventor's recently-published U.S. patent application Ser. No. 10/926,965 and corresponding international application no. PCT/CA2004/001575, but preferably is simply blocked against retraction by the actuating mechanism itself, as will be explained below.

Further aspects of the invention will be described or will become apparent in the course of the following detailed description and drawings of specific embodiments of the invention, as examples.

BRIEF DESCRIPTION OF THE DRAWINGS

Embodiments of the invention will now be described, by way of example only, with reference to the attached drawings of the preferred embodiment, in which.

DETAILED DESCRIPTION OF THE INVENTION

A preferred embodiment of the invention is illustrated in the accompanying drawings. Of course the principle of the invention may be implemented in ways which are not identical to the preferred embodiment.

Figure 1:
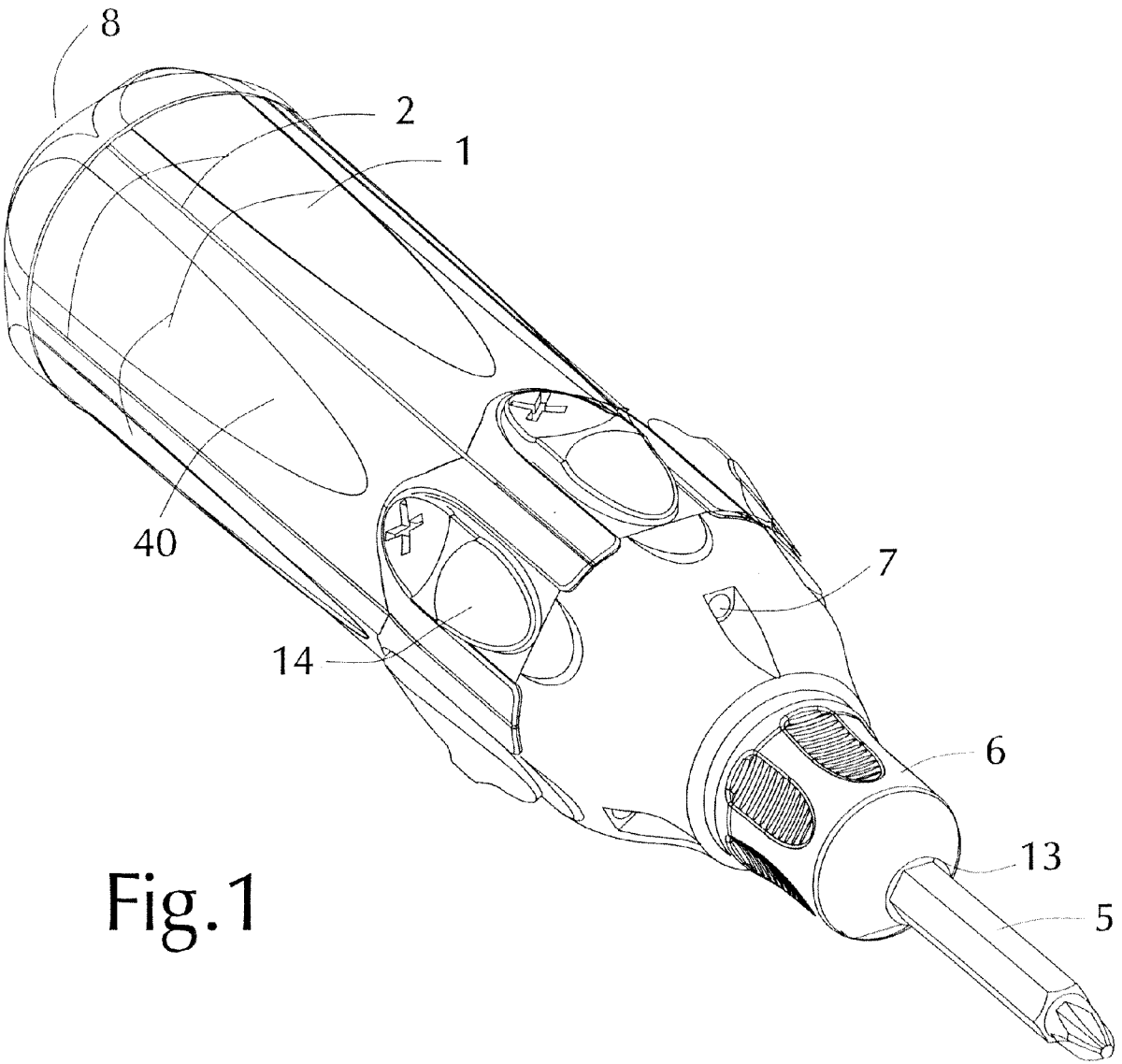
FIG. 1 is a perspective view of the tool.

FIG. 1 shows a number of cartridges 1 assembled together, the cartridges engaging each other along abutting longitudinal edges 2. In the preferred embodiment, there are six such cartridges, though that number obviously could be varied as desired.

Figure 2:
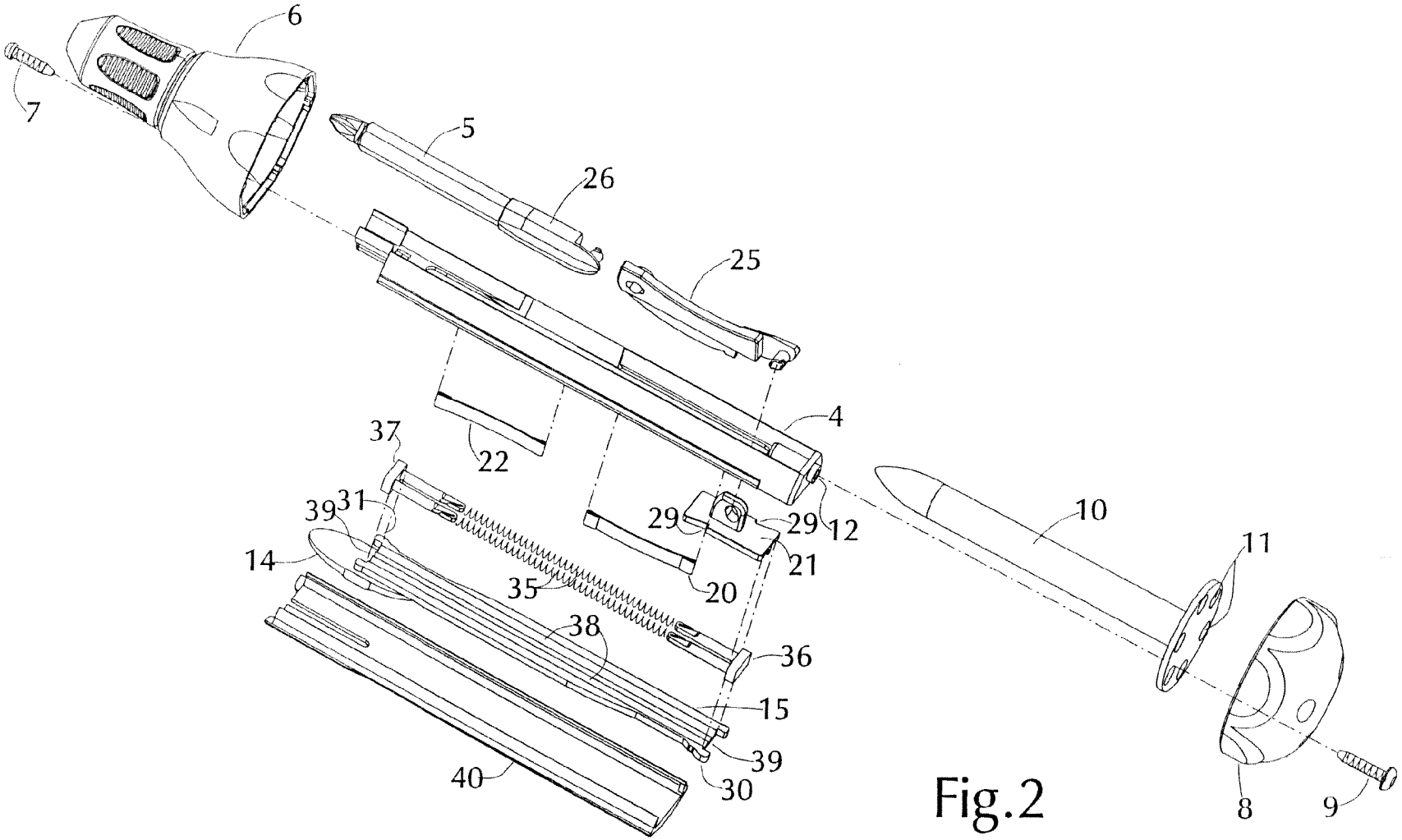
FIG. 2 is an exploded perspective.
Figure 3:
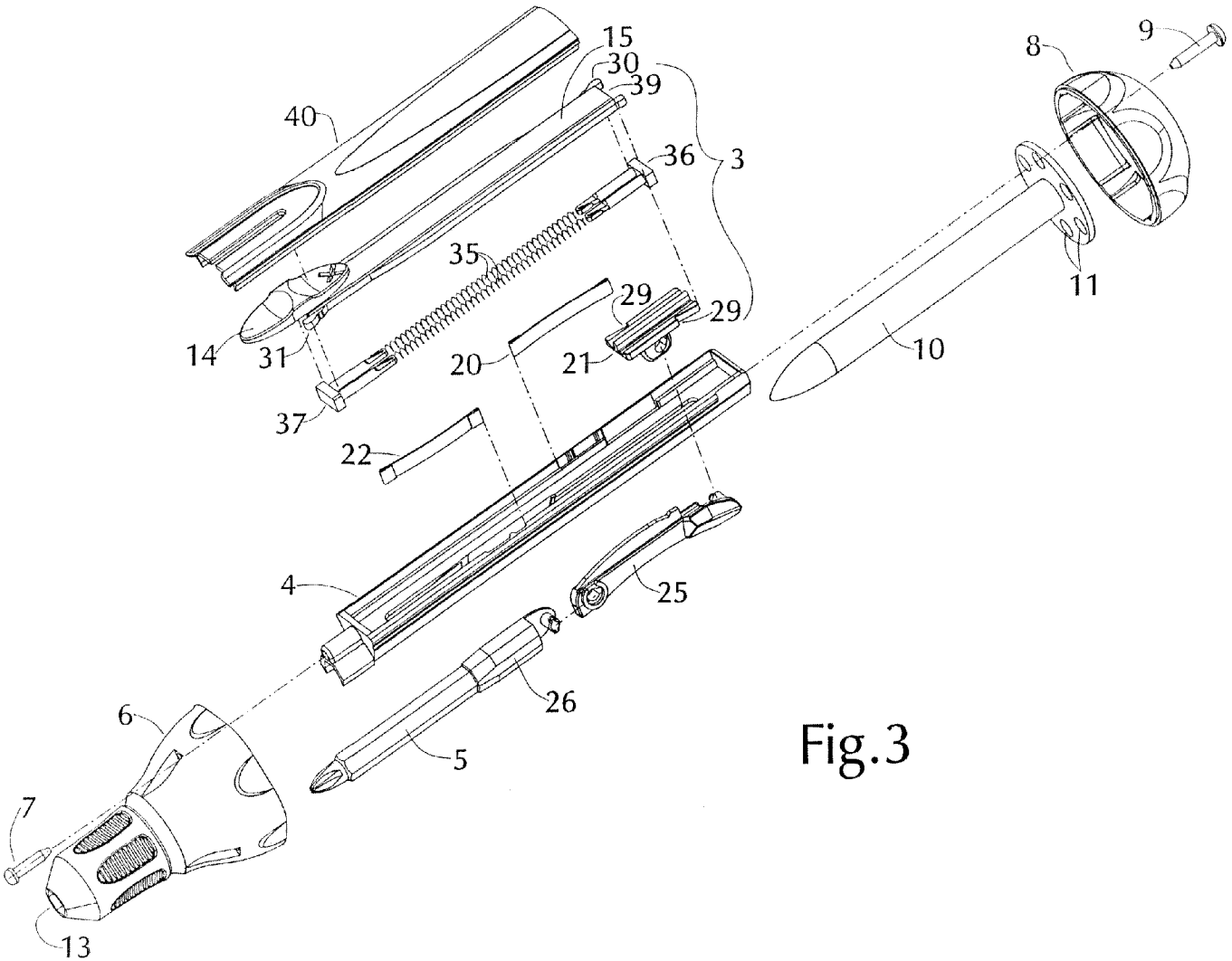
FIG. 3 is an exploded perspective from a different angle.

As seen best in FIGS. 2 and 3, each cartridge 1 has its own spring-loaded actuation mechanism 3, carried by a cartridge body 4 for extending or retracting a bit 5 through a collar 6 at the distal end of the tool. The collar is secured to the distal end of the cartridges by any suitable means, for example by several screws 7 between the collar and the distal ends of several of the cartridge bodies. An end cap 8 is mounted on the top or proximal end of the cartridges, for example by several screws 9 into the cartridge bodies. A center guide 10 extends axially from the end cap, and is held in place by a flange between the end cap and the cartridge bodies, the flange having a number of holes 11 each fitting over a post 12 on the distal end of each cartridge body.

The collar 6 provides a passageway for extension and retraction of the bits, tapering from a proximal portion wide enough to receive any of the various bits, to a distal central axial opening 13 dimensioned to accommodate just one bit, i.e. one selected by the user. The distal opening has a cross-section corresponding to the cross-section of the bit at that point when extended, hexagonal for example, to prevent the bit from rotating when torqued.

The spring-loaded mechanism 3 in each cartridge translates a small movement of an actuation button 14 into rapid and much larger movement of the bit 5 associated with that cartridge, whether that movement is extension or retraction.

The actuation button 14 is secured to or preferably integrally molded with a trigger 15 which slides within the cartridge body 4. The purpose of the trigger is to contact either an extension release leaf spring 20 to allow an actuation slider 21 to be released towards an extended-bit position, or a retraction release leaf spring 22 to allow the actuation slider to be released towards a retracted-bit position. The leaf springs fit into recesses 23 in the walls of the cartridge bodies.

Figure 4A:
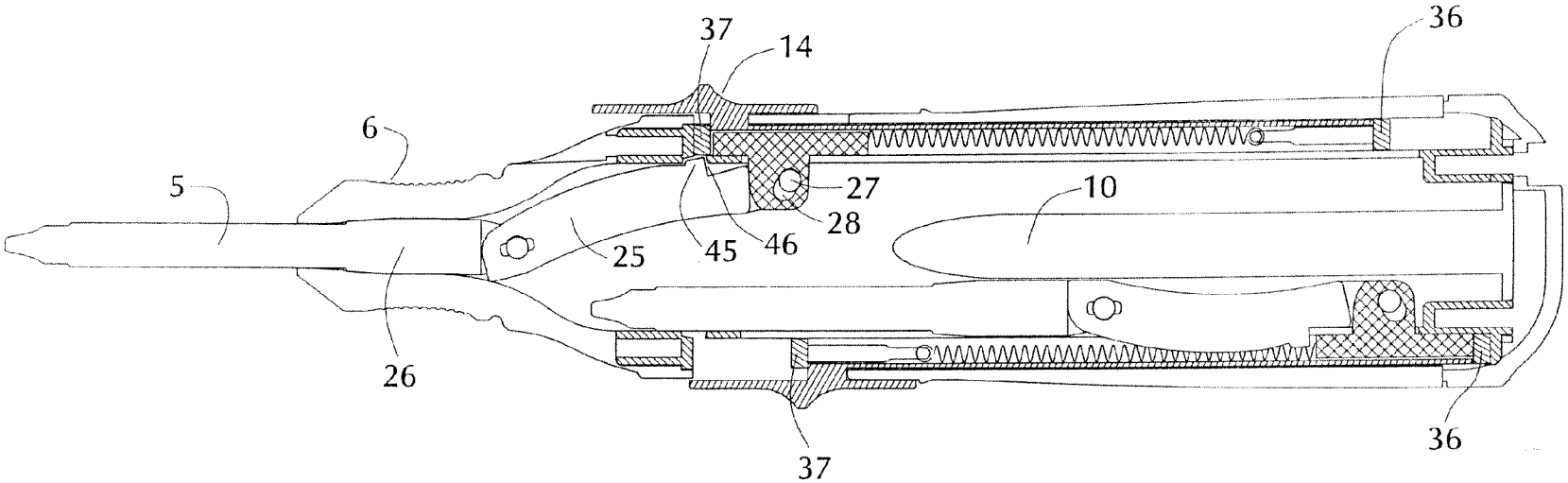
FIG. 4A is a cross-section showing the internal mechanism, with a bit fully advanced.

A connecting rod 25 is pivotally connected between the actuation slider 21 and the proximal end of a bit extension 26 secured to the proximal end of the bit 5 or other tool element. The connecting rod also acts as a locking arm, to hold an extended bit in its operative position. As can be seen in FIG. 4A, the connecting rod connects to the actuation slider via a pin 27 on the connecting rod in an angled slot 28 in the actuation slider 21. As the actuation slider moves forward, the effect of the angled slot is to urge the connecting rod outwardly. This results in a shoulder 45 engaging a notch 46, so that the notch takes any axial compression load on the bit, with the fact that the actuation slider is also locked in place acting as a backup, in effect. An extended bit may be locked in place by any other suitable means, if desired.

Figure 4B:
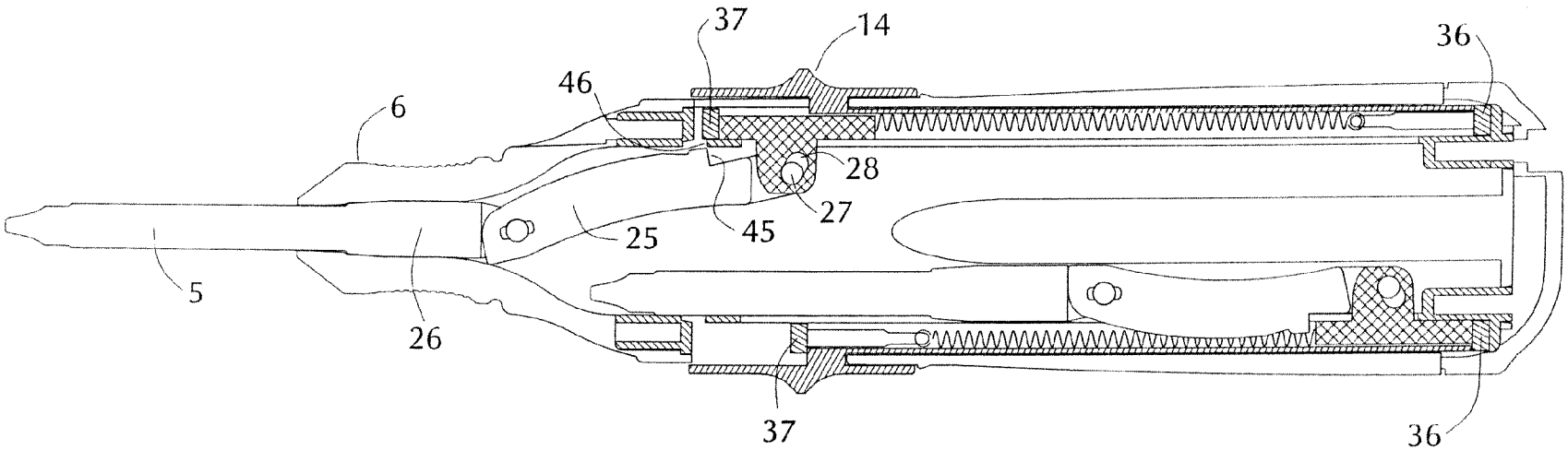
FIG. 4B is a corresponding cross-section, showing the bit just beginning to be retracted by the actuation slider.

FIG. 4B shows that just as the actuation slider is released to retract a bit, the angled slot 28 has the effect of kicking the connecting rod inwardly, thereby disengaging the shoulder 45 from the notch 46, allowing the bit to retract.

The center guide 10 plays an important role as bits are extended or retracted, by keeping the bits, bit extensions and connecting rods from interfering with each other, by urging them outwardly away from the axis of the tool when retracting. The distal end of the center guide preferably is rounded or tapered.

Figure 5:
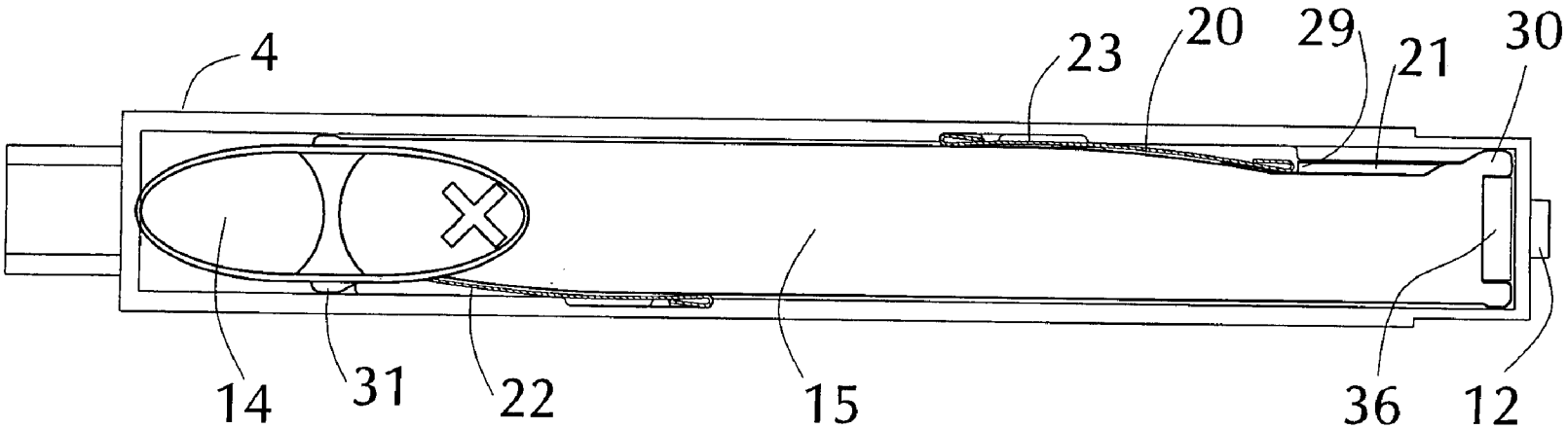
FIG. 5 is a plan view of one of the cartridges.
Figure 6:
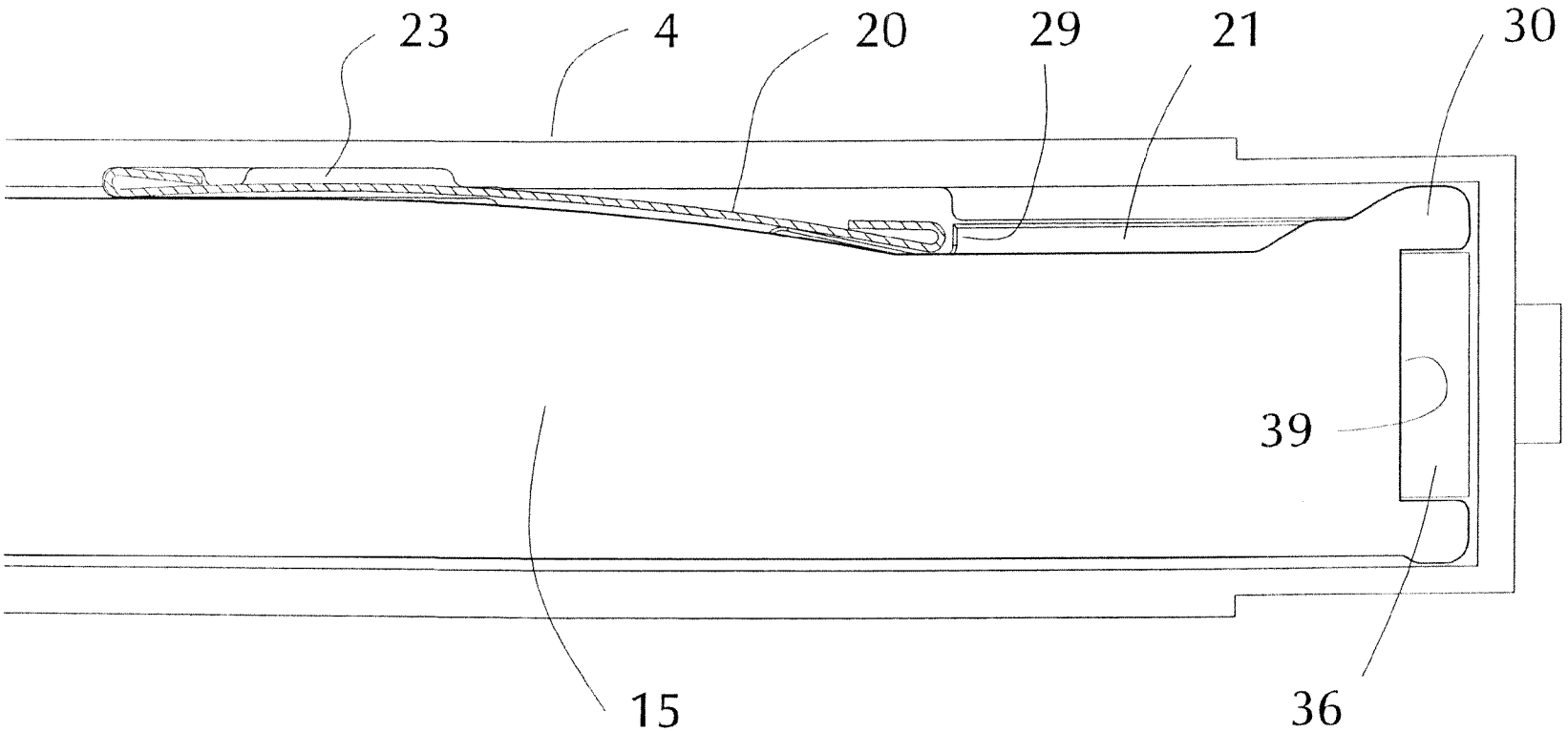
FIG. 6 is an enlarged view corresponding to FIG. 5.
Figure 7:
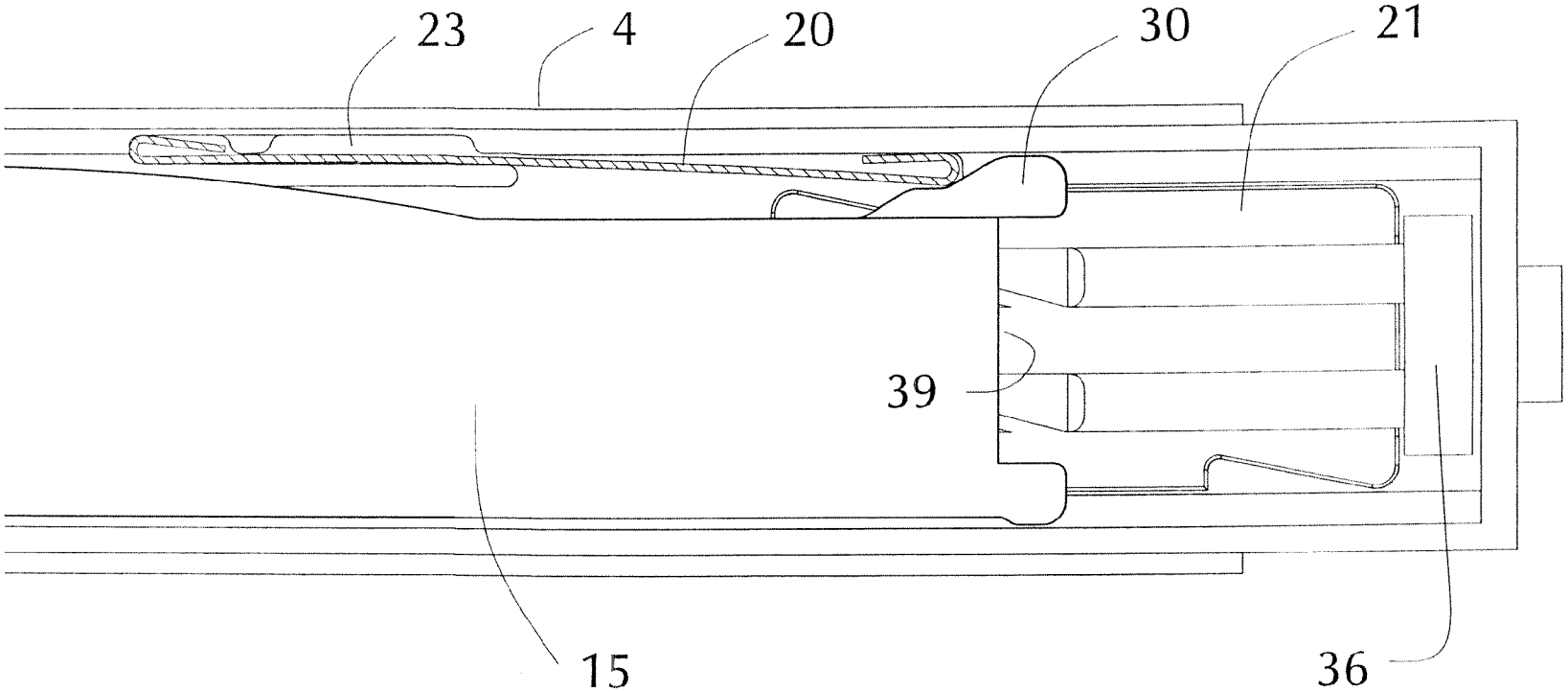
FIG. 7 is an enlarged view corresponding to FIG. 6, but with the trigger moved forward to the point of displacing the leaf spring to release the actuation slider.

As best seen in FIGS. 5-7, the actuation slider 21 is normally locked in either the extended or retracted position, by virtue of one or the other of the leaf springs 20, 22 engaging one or the other of two shoulders 29 on the actuation slider. The trigger 15 has lateral projections, i.e. proximal and distal cams 30, 31 respectively, which contact a respective leaf spring to push it laterally so that it no longer engages the shoulder.

When the actuation slider is in one of its two positions but is released therefrom by the trigger displacing the relevant leaf spring, it is launched to its other position by the effect of actuation springs 35. It should be noticed that by selecting a relatively long trigger and by spacing the cams 30, 31 relatively far apart as this permits, only a relatively small movement of the trigger is necessary to move from the position where one of the leaf springs is released to the position where the other is released. The actuation slider thus travels a much larger distance than the trigger.

The actuation springs 35 are mounted between two blocks, namely a proximal block 36 and a distal block 37, and are sandwiched between the cartridge body and the trigger, in grooves 38 in the trigger. The ends of the blocks extend inwardly and outwardly, so that the outward extensions can be engaged by opposite ends of the trigger, in notches 39, and so that the inward extensions can be engaged by the actuation slider 21.

When a particular cartridge's bit is in its retracted position, the proximal block 36 is held in position behind the actuation slider, by the actuation slider. As the actuation button and trigger are moved forward, the distal block 37 is carried with it, stretching the actuation springs. When fully forward, the proximal cam 30 engages the extension release leaf spring 20 to release the actuation slider, and the actuation slider is launched forward by the actuation springs. Inertia carries the slider forward to the point where it is caught by the retraction release leaf spring 22.

Similarly, when the user wants to retract the bit, the distal block 37 is held in position by the actuation slider. As the actuation button and slider are moved rearward, the proximal block 36 is carried with it, stretching the actuation springs. When the actuation button and trigger are fully to the rear, the distal cam 31 engages the retraction release leaf spring 22 to release the actuation slider, and the actuation slider is launched rearwardly by the actuation springs. The actuation slider then catches at the rear extension release relief spring 20.

A cartridge cover 40 slides over each cartridge body 4, to hold all cartridge components in place. Together, the cartridge covers act as an external surface or handle for the tool. Their longitudinal-edges contact each other, and if desired may be provided with complementary engagement means such as dovetailing or tongue-and-grooving.

Variations on the preferred embodiment described above are conceivable within the broad scope of the invention. It should therefore be understood that the claims which define the invention are not restricted to the specific embodiment described above. Further variations may be apparent or become apparent to those knowledgeable in the field of the invention, and are within the scope of the invention as defined by the claims which follow.

The invention claimed is:

1. A hand tool having a plurality of tool elements, said tool elements being selectively extendable and retractable through a collar having a central axial opening, from a retracted position in a handle portion to an operative position extending from said collar through said axial opening, said hand tool comprising a plurality of spring-loaded mechanisms assembled around a central axis, each spring-loaded mechanism having a tool element extendable and retractable by said spring-loaded mechanism, each spring-loaded mechanism further having an actuation button on an external surface of said hand tool to trigger said spring-loaded mechanism for extension and retraction of said tool element, wherein movement of a said actuation button triggers a substantially larger movement of a said tool element, and wherein said spring-loaded mechanisms are in individual cartridges assembled together around said central axis, engaging each other along abutting longitudinal edges, wherein each said spring-loaded actuation mechanism comprises:

a cartridge body having a trigger slidable therein by movement of said actuation button, an actuation slider connected to a said tool element, slidable between a retracted position corresponding to said tool element being retracted, and an extended position corresponding to said tool element being extended;

cam means on said trigger for contacting an extension release means for allowing said actuation slider to be released from its retracted position towards its extended position, and a retraction release means for allowing the actuation slider to be released from its extended position towards its retracted position; and at least one spring biased to launch said actuation slider when released by either of said release means, from one to the other of the retracted and extended positions, said release means at said other position then engaging said actuation slider to retain it there.

2. A hand tool as in claim 1, wherein said extension release means and said retraction release means are leaf springs biased to engage said actuation slider, said cam means contacting said leaf springs to disengage them from said actuation slider.

3. A hand tool as in claim 2, wherein a cartridge cover slides over each cartridge body, to hold all cartridge components in place, said cartridge covers together acting as an external surface and handle for the tool.

4. A hand tool as in claim 1, wherein said actuation slider is connected to said tool element by a connecting rod, said connecting rod having a shoulder engaging an element on said cartridge body when said tool element is extended, thereby preventing retraction of said tool element when said actuation slider is engaged at said extended position, said actuation slider causing said shoulder to disengage when said actuation slider is released towards said retracted position.

5. A hand tool as in claim 4, wherein a cartridge cover slides over each cartridge body, to hold all cartridge components in place, said cartridge covers together acting as an external surface and handle for the tool.

6. A hand tool as in claim 1, wherein said at least one spring biased to launch said actuation slider is/are mounted between two blocks, positioned between the cartridge body and the trigger, with the actuation slider between said blocks, such that when said trigger is moved from either of its positions, said spring(s) is/are extended between said actuation slider and said trigger, to launch said actuation slider once released by the effect of said cam means.

7. A hand tool as in claim 6, wherein a cartridge cover slides over each cartridge body, to hold all cartridge components in place, said cartridge covers together acting as an external surface and handle for the tool.

8. A hand tool as in claim 1, wherein a cartridge cover slides over each cartridge body, to hold all cartridge components in place, said cartridge covers together acting as an external surface and handle for the tool.

9. A hand tool as in claim 1, wherein:

said extension release means and said retraction release means are leaf springs biased to engage said actuation slider, said cam means contacting said leaf springs to disengage them from said actuation slider;

said actuation slider is connected to said tool element by a connecting rod, said connecting rod having a shoulder engaging an element on said cartridge body when said tool element is extended, thereby preventing retraction of said tool element when said actuation slider is engaged at said extended position, said actuation slider causing said shoulder to disengage when said actuation slider is released towards said retracted position; and said at least one spring biased to launch said actuation slider is/are mounted between two blocks, positioned between the cartridge body and the trigger, with the actuation slider between said blocks, such that when said trigger is moved from either of its positions, said spring(s) is/are extended between said actuation slider and said trigger, to launch said actuation slider once released by the effect of said cam means.

10. A hand tool as in claim 9, wherein a cartridge cover slides over each cartridge body, to hold all cartridge components in place, said cartridge covers together acting as an external surface and handle for the tool.

* * * * *